US012331599B1

(12) United States Patent
Comacchio et al.

(10) Patent No.: US 12,331,599 B1
(45) Date of Patent: Jun. 17, 2025

(54) DRILLING MACHINE WITH IMPROVED CAROUSEL LOADING DEVICE

(71) Applicant: Comacchio SpA, Riese Pio X (IT)

(72) Inventors: Renzo Comacchio, Riese Pio X (IT); Pasqualino Comacchio, Riese Pio X (IT); Patrizio Comacchio, Riese Pio X (IT)

( * ) Notice: Subject to any disclaimer, the term of this patent is extended or adjusted under 35 U.S.C. 154(b) by 0 days.

(21) Appl. No.: 18/842,043

(22) PCT Filed: Mar. 7, 2022

(86) PCT No.: PCT/IB2022/051991

§ 371 (c)(1),
(2) Date: Aug. 28, 2024

(87) PCT Pub. No.: WO2023/170445

PCT Pub. Date: Sep. 14, 2023

(51) Int. Cl.
*E21B 19/14* (2006.01)

(52) U.S. Cl.
CPC ..... *E21B 19/146* (2013.01)

(58) Field of Classification Search
CPC ..... E21B 19/146
See application file for complete search history.

(56) References Cited

U.S. PATENT DOCUMENTS 5,174,389 A * 12/1992 Hansen ..... E21B 19/146 175/85
5,297,642 A 3/1994 Rajakallio

FOREIGN PATENT DOCUMENTS

DE 29623819 U1 * 12/1999 ..... E21B 19/146
EP 2851503 3/2015
ES 2348733 T3 * 12/2010 ..... E21B 19/146
GB 2155974 A * 10/1985 ..... E21B 19/146
WO 2007129337 11/2007
WO WO-2012025804 A1 * 3/2012 ..... E21B 19/14

* cited by examiner

*Primary Examiner* — Aaron L Lembo
(74) *Attorney, Agent, or Firm* — Themis Law; Franco A. Serafini

(57) ABSTRACT

A drilling machine includes a loading device of the carousel type for a plurality of rod modules and optionally a plurality of covering modules. The loading device includes a platform, on which the rod modules are arranged to be orthogonal to the platform, and a conveyor system for conveying the rod modules along a closed path. The carousel loading device includes a lateral containment frame provided with an opening for the extraction and/or insertion of the rod modules through the translation of the rod modules in a direction that is substantially parallel to the platform or has at least one component parallel to the platform.

14 Claims, 5 Drawing Sheets

DRILLING MACHINE WITH IMPROVED CAROUSEL LOADING DEVICE

This patent relates to drilling machines and in particular concerns a drilling machine with an improved carousel loading device for drill rods and/or rods and coverings. The prior art includes drilling machines equipped with a drill bit connected to the machine body by means of a special drill rod and/or double system with a drill rod and covering.

Said drill rod is hollow and is made up of various sections, hereinafter called rod modules, which are hollow pipes, joined by threads, that is, able to be screwed to each other.

Similarly, drill coverings are hollow tubular bodies made up of various sections, hereinafter called covering modules, joined together by threads, and thus able to be screwed to each other. Drill coverings are intended to contain the rods during drilling, where drill rods and drill coverings rotate synchronously during the drilling itself.

In the case of drilling with drill rods only, the latter can be conventional for drilling with the direct circulation method or dual wall drill rods for perforations with the reverse circulation method.

Each of the modules that make up said drill rod have a length of about 2-4 meters and are progressively screwed to each other as the drilling progresses.

Initially, the drill bit is connected to the machine body through the first rod module. The drilling machine carries out the drilling by transmitting to said rod module, and therefore to the drill bit, a rotational-translational motion directed towards the ground.

When the borehole is deep enough so that said rod module is almost completely inserted into the ground, the drilling is interrupted and another rod module is screwed on to continue drilling.

This operation is repeated until the drill bit reaches the desired depth.

The prior art includes some drilling machines equipped with special loaders, made up of a system of mechanical arms that grab a rod module and align it with the rod module already inserted in the ground.

The prior art also includes drilling machines with a revolver loader, with or without auxiliary mechanical arms for positioning the rod modules.

In the event that the drilling requires the use of the aforementioned drill coverings, each rod module in the loader is housed inside a drill covering module. The two modules are extracted from the loader and screwed into the corresponding modules already inserted in the ground, thus proceeding with the drilling as described above.

The prior art also includes carousel loaders, which contain a plurality of rods placed orthogonally to a supporting platform, on which they are moved by means of special pulling means such as chains, belts or wheels, so that at least one rod module is always available in a picking position.

A system of arms or grippers then picks up the rod module and hooks it to the operating head, or the operating head itself picks up the rod module from the pickup position in the loader.

The rod is extracted from the loader by sliding it orthogonally with respect to said platform. In order to be pulled out of the loader, the rod must be lifted beyond the upper containment ring, so that it can then be handled by the operating head and brought into alignment with the drilling axis. For this reason, the length of the rod modules must be relatively contained, preferably about two meters, in order to contain the mast length within the machine's transportability parameters. On the other hand, however, this increases the number of modules needed to conduct a drill. One drawback of the drilling machines with a carousel loader of the prior art is the limited capacity to contain rods. Therefore, it is necessary to take additional rod magazines to the drilling site, in order to resupply the loader once it is empty.

In some situations, such as in mountain drilling, or where the space available for the equipment is limited, there are obvious difficulties to resupply the drilling machine with new rods.

The object of this patent is a bore drilling machine, with a new improved carousel loader for drill rods and/or rods and drill coverings.

The main object of the present invention is to maximize the capacity of the carousel loader.

Another object of the present invention is to be able to insert rod modules and/or rods and drill coverings of any length compatible with the mast stroke, into the carousel loader, since the extraction/insertion of rod modules and/or rods and drill coverings from/into the loader does not take place through translation orthogonal to the platform but through translation in a direction parallel to the platform itself, since it is necessary to pass over the upper containment ring.

Another object of the present invention is to optimize the length of the mast, since the stroke required by the operating head to perform the extraction of the rod modules from the loader is shorter. Consequently, the handling times and therefore the drilling times as well as the transportability of the rig are also optimized.

One of the advantages of the present invention is that it can also be used in limited space, since it has a high load capacity, understood as the overall length of the loaded rod modules, and therefore does not need to be served by auxiliary magazines.

The new drilling machine with improved carousel loader is particularly suited for core surveys, geothermal drilling, grade control and general drilling.

These and other objects, direct and complementary, are achieved by the new drilling machine with improved carousel loader for drill rods and/or rods and drill coverings. The new drilling machine consists in its main parts of a machine body, at least one mast, at least one mobile operating head and devices for gripping and positioning drill rods and/or rods and drill coverings, at least one carousel loader for the component modules called drill rods and/or drill coverings.

In particular, the new drilling machine comprises at least one operating head with at least one spindle on the upper end of a rod module, suited to give said rod module a rotary motion to screw and connect each rod module to another already in the ground and a rototranslational motion to carry out the drilling and extraction of the rod.

Said operating head may be of the type also comprising a second spindle on the upper end of a drill covering module, suited to give said drill covering module a rotary motion to connect/disconnect a drill covering module to/from a second drill covering module, and a rotary motion integral with the rotation of the drill rod in order to perform drilling and extraction.

The new carousel loader for the modules comprising said drill rods and/or drill coverings comprises a platform and pulling means suited to slide said drill rods and drill coverings along a closed path. Said pulling means comprise for example belts and/or straps and/or sliding chains, along which a plurality of forks, cups or seats in general are distributed, specially configured to hold and pull said drill rod modules and drill covering modules, for example in a position preferably orthogonal to said platform.

The new drilling machine is equipped with a kinematic mechanism for the movement of the mast that guarantees the orthogonality between the mast and the loading plane of the drill rods and drill coverings. The preferred position of said loader platform is horizontal, to ensure the vertical stability of the drill rods and drill coverings.

The new drilling machine therefore also preferably comprises one or more jacks, which, during the positioning phase before drilling, have the function of positioning said platform in a preferably horizontal position, so that said drill rod and drill covering modules are preferably vertical, even if different angles are allowed in the context of the stability of the rods.

Said loader can also comprise one or more tensioning shafts or pins, orthogonal to said platform and rotating around their vertical axis, causing the rotation of one or more toothed wheels in turn connected to said belts and/or chains and/or straps.

In this way, said belts or sliding chains, pulled by said toothed wheels, slide and cause the movement of said drill rod modules and drill covering modules inserted within said seats or forks integral with the sliding belts themselves.

At least one picking position is identified within said loader, that is, the position from which a drill rod module or a drill covering module is picked.

After the modules are picked up, the means that cause said pulling means to slide are activated to reposition another drill rod module or drill covering module in that same picking position, for the subsequent cycle.

Said loader of the new drilling machine also comprises at least one device or gripper for locking the drill rod and the drill covering modules during the picking and repositioning of the modules in the picking position within the loader.

Said gripper has the function of constraining the drill rod or drill covering module during the screwing/unscrewing of the operating head on the relative module.

Said pulling means may also comprise one or more housings for the drill tools, as well as for the drill rod or drill covering modules, which can then be selectively transported to said picking position to be picked up by said operating head.

The improved loader also makes it possible to load longer modules than the carousel loaders of the prior art, thanks to its particular configuration at said picking position, described and claimed below.

Said carousel loader comprises one or more walls or lateral containment means able to contain the drill rod and drill covering modules preventing them from accidentally falling towards the outside of the loader.

At or near said picking position, said walls or containment frame comprise at least one opening, preferably all along its height or in any case high enough to allow the extraction of the drill rod and drill covering modules as well as the drill bit from the loader, where this extraction does not therefore take place by translating the drill rod or drill covering modules or the drill bit orthogonally to the platform, that is, vertically, but takes place by translating the drill rod or drill covering modules or the drill bit in a direction substantially parallel to the platform, that is, preferably horizontal or basically horizontal.

Said opening has closing means that can be selectively opened during the extraction of the drill rod or drill covering modules, while said closing means remain closed to prevent the drill rod or drill covering modules from coming out or being extracted accidentally.

Said closing means preferably comprise one or more rollers elastically constrained to said walls and lateral containment means, normally placed in their closed position to prevent the accidental extraction of drill rod and drill covering modules or the drill bit, and which are also able to be opened to enable said extraction.

The opening of said closing means may take place automatically or by the simple direct thrust by said drill rod or drill covering modules or drill bit grasped by the operating head.

Conversely, the closure of said closing means is automatic.

Thanks to this feature, the operating head does not have to make a stroke equal to the length of the drill rod to pull it upwards, but a much shorter stroke. As a result, the length of the mast can also be considerably shorter, and the maneuvering time minimized.

In the event that the drilling involves drill covering modules coupled to the drill rod modules, said drill rod modules will be positioned inside the drill covering modules, so that the operating head, suitably equipped with said second spindle for connecting a drill covering module, can first grasp and extract a drill rod module, and subsequently the coaxial drill covering module. The drill covering module containing the drill rod module is then moved to said picking position, where it will be picked up together with the drill rod module by horizontal translation through said opening.

Conversely, during the removal of the drill rod and drill covering modules from the ground, all the drill rod modules will first be extracted, and placed individually inside the loader consecutively.

Afterwards, all the drill covering modules will be extracted and placed coaxially to the drill rod modules already housed in the loader.

The characteristics of the drilling machine with improved carousel loader will be better clarified by the following description with reference to the drawings, attached by way of a non-limiting example.

A detail of the new carousel loader (100) is shown in

FIG. 1 in a side view where the extraction opening (10) is shown at the picking position (X).

FIG. 5 shows a plan view of just the carousel (100) with locking clamp (6), while

Figure 1:
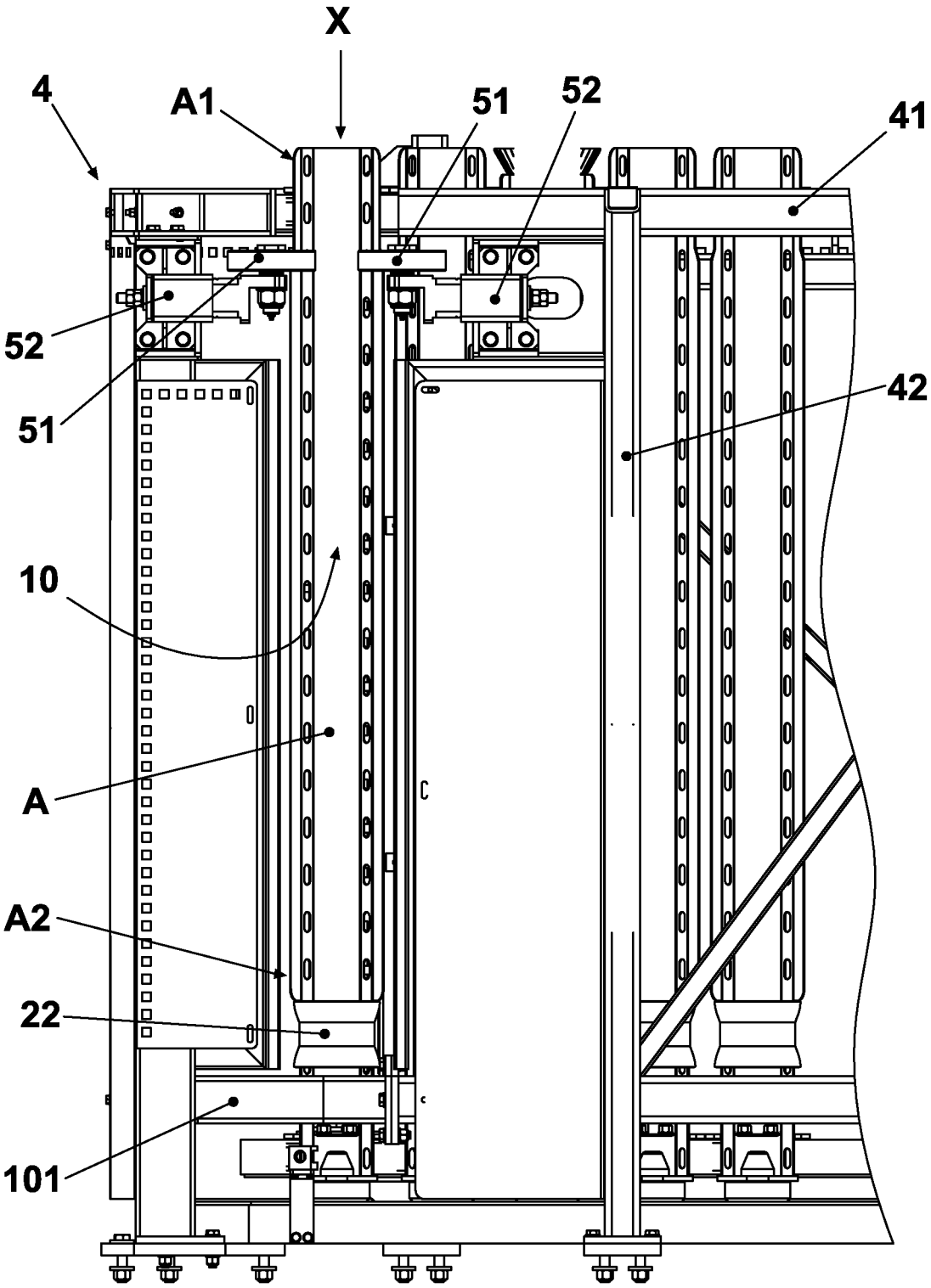
Figure 2:
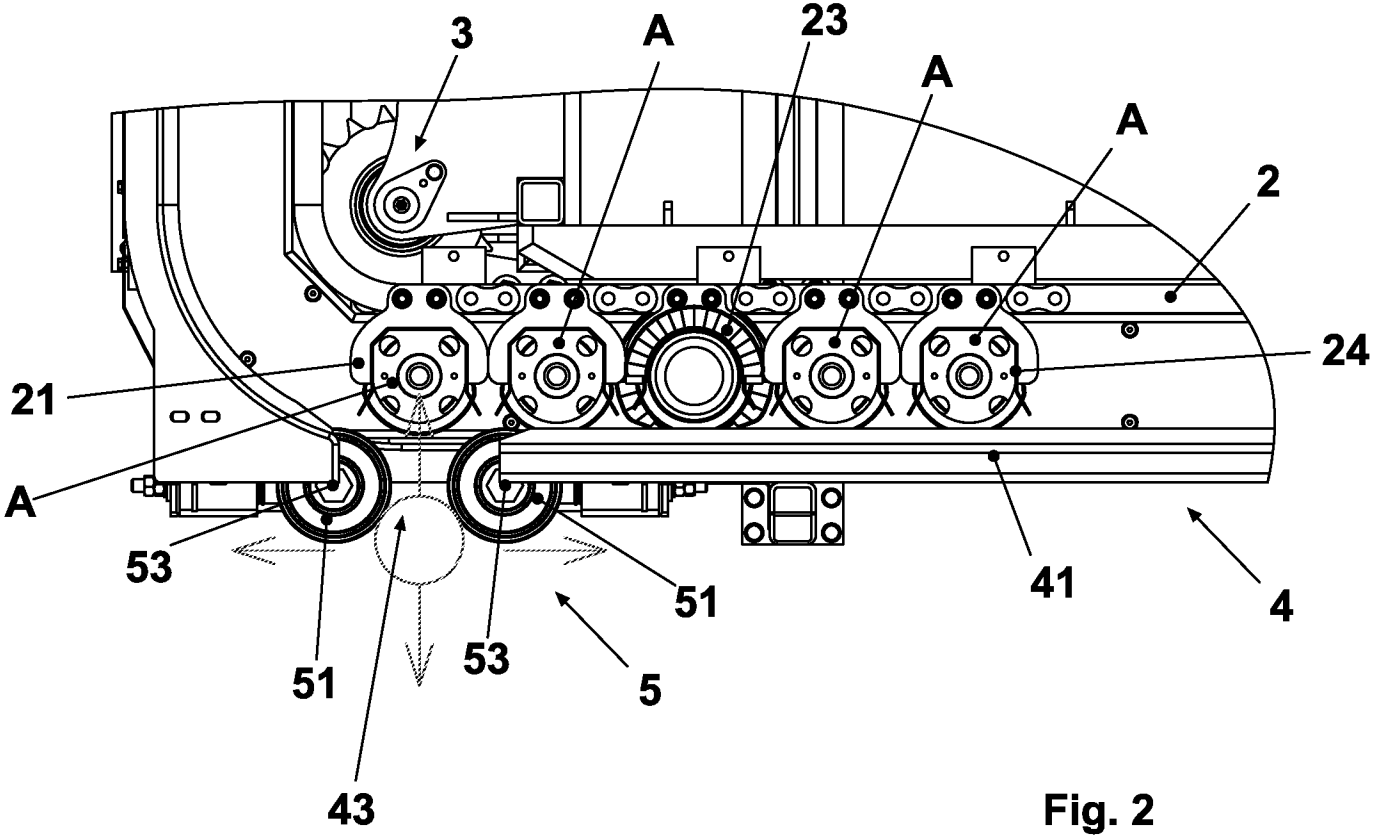
FIG. 2 shows the detail of FIG. 1 in plan view.

The new drilling machine substantially comprises a compact machine body with a loader (100) of the carousel or revolver type, in turn comprising a platform (101) for supporting and enabling the movement of a plurality of drill rod modules (A), that is, the modules that, connected to each other, make up a drilling assembly, and/or drill covering modules, not shown in the figures.

The new drilling machine also comprises at least one mast (M), placed in a lateral position with respect to said loader (100) and equipped with at least one rotating main operating head (R), for the attachment, alignment, connection and rotation of the drill rod modules (A) and possibly also of said drill covering modules.

As noted, said drill rod, like the drill rods of the prior art, is substantially made up of several segments, hereinafter called drill rod modules (A), which are joined to each other for example by screwing them on to each other by means of a thread.

Said mast (M) rotates on the vertical plane, being able to be placed in a stand-by position, inclined with respect to said platform (101), or in an operating position, that is, orthogonally with respect to said platform (101).

Said operating head (R) can move vertically along said mast (M) and translate orthogonally with respect to the mast (M), sliding along a guide.

Said operating head (R) can therefore translate horizontally at least between a position aligned with the axis of said mast (M) and a position aligned with the axis of a picking position (X) on said loader (100), where the gripping and extraction of one of the drill rod modules (A) contained in the loader (100) takes place.

Said operating head (R), like the operating heads of the prior art, comprises at least one spindle or coupling device, suitable for inserting and attaching the upper end (A1) of a drill rod module (A).

Said operating head (R) may also comprise a second spindle or coupling device suitable for inserting and attaching the upper end of a drill covering module.

Said carousel loader (100) for drill rod (A) and/or drill covering modules comprises means for pulling the drill rod (A)/drill covering modules and in a preferred embodiment comprises one or more belts, straps or sliding chains (2), so as to form a closed loop, substantially parallel to said platform (101).

One or more rotating shafts and sprockets (3), mechanically connected to said one or more chains (2), cause them to slide.

Said one or more chains (2) comprise a plurality of containment means of the drill rod (A)/drill covering modules in a position preferably orthogonal to said platform (101).

For example, said containment means comprise forks (21), arranged so as to directly or indirectly contain the drill rod (A)/drill covering modules at an intermediate height, and/or cups (22) or seats in general configured to accommodate the lower end (A2) of said drill rod (A)/drill covering module.

The drill rod modules (A) are then loaded on said loader (100) so as to be placed side by side along said closed loop made up of said chains (2) and so as to slide all together with the chains (2) themselves.

In the event that it is also necessary to use drill covering modules, said drill rod modules (A) will be loaded on said loader (100) coaxially.

During the sliding of said one or more chains (2), said drill rod (A)/drill covering modules are kept in a position orthogonal to said platform (101), while carrying out a translation motion along said closed loop.

In order to maintain the vertical position of said drill rod (A)/drill covering modules, said loader (101) further comprises means or walls or an external containment frame (4).

In the embodiment shown in the figures, the loader (101) comprises a frame (4) in turn made up of one or more retaining rings or side walls (41), and one or more supporting side uprights (42).

During operation, said mast (M) remains fixed in a position orthogonal to said platform (101), while said operating head (R) slides horizontally so as to translate from said position aligned with said mast (M) to a position aligned with a defined picking position (X) within the loader (101), where said spindle of the operating head (R) is screwed on the upper end (A1) of the drill rod module (A) or of the drill covering module placed in said picking position (X).

At least at said picking position (X), said frame (4) comprises an opening (43) for the extraction of said drill rod modules (A) and said drill covering modules.

Selective closing means (5) for the extraction opening (43) are mounted at the opening (43) itself.

Said closing means (5) comprise for example and preferably one or more movable rollers (51), constrained to said frame (4) near said extraction opening (43) and normally placed so as to at least partially block said opening (43), thus preventing the drill rod module (A) or the possible drill covering module at said picking position (X) from coming out accidentally.

In the embodiment shown in the figures, each of said one or more movable rollers (51) is constrained to said frame (4) by brackets (52) that enable the movement of the roller (51) from the blocking position of the extraction opening (43) to a displaced position, in which it does not prevent the extraction of the drill rod module (A) or drill covering module. For example, said brackets (52) enable the sliding of the roller (51) outwards, with respect to the loader (101) and/or parallel to the frame (4).

For example, said brackets (52) can be provided with elastic means that normally hold said rollers (51) in said blocking position.

To extract a rod module (A) or a drill covering module from the picking position (X) the operating head (R) simply grasps the drill rod (A)/drill covering module, unhooks it from the fork (21) and/or from the containment cup (22), and transports it horizontally towards the extraction opening (43) so that the drill rod (A)/drill covering module pushes said one or more rollers (51) causing them to be displaced.

Once the drill rod module (A) or drill covering module are extracted, said one or more rollers (51) return to said blocking position automatically.

In the preferred embodiment shown in the figures, said selective closing means (5) comprise two of said rollers (51) placed symmetrically on the two sides of the extraction opening (43), preferably in its upper area, each roller (51) being constrained to the frame (4) with its own bracket (52).

Said rollers (51) may also be rotatable around their own central rotation axis (53) to facilitate the extraction of the drill rod modules (A) or the drill covering modules.

Said one or more chains (2) may also be equipped with forks and/or cups and/or seats in general (23) to retain one or more tools, which will therefore also be placed side by side to said drill rod modules (A) and/or said drill covering modules and able to slide along with them.

In addition, in this case, in order to pick up a tool, it will be sufficient to slide said chains (2) until the desired tool is brought into said picking position (X).

Said loader (101) of the new drilling machine also comprises at least one locking device or clamp (6) for said drill rod (A) modules/drill covering modules able to constrain and hold them in said picking position (X) during the coupling phase of the operating head (R).

Said clamp (6) may, for example, comprise a main body (61) where at least one pair of jaws (62) are hinged and suited to grasp and hold said drill rod module/drill covering module, and where said jaws can move, that is, can open and close, for example by means of a cylinder, the extension/contraction of which causes the rotation of said jaws, and therefore, their opening/closure.

In a preferred embodiment, said jaws (62) have a concave surface (63) that comes in contact with the walls of said drill rod (A) modules/drill covering modules.

Said clamp (6) is also preferably able to translate in a direction parallel to said drill rod modules (A) inserted inside the loader (100).

Therefore, said clamp (6) is intended to hold the drill rod (A) module/drill covering module in said picking position (X) during the coupling phase of the operating head (R).

To grasp a drill rod (A) or drill covering module, said clamp (6) makes a translational movement towards said drill rod (A) or drill covering module positioned in said picking position (X) and grabs it.

Once the operating head (R) has correctly engaged the drill rod (A) or drill covering module, said clamp releases the module (A) and performs a translational movement backwards to enable the rotation of the drill rod (A) or drill covering module in the loader.

At this point the head (R) extracts the module (A) from the loader (100) as previously described, that is, by extracting it from the cup (22) by moving it horizontally, not vertically, and removing it through said extraction opening (43).

The reinsertion of the drill rod (A) or drill covering modules inside the loader (101) after use follows the opposite procedure.

In particular, the spindle (R1) of the operating head (R) grips the upper end (A1) of the last drill rod module (A) inserted in the ground, which is fully extracted from the borehole and disconnected from the next drill rod module (A), still partially inserted in the ground.

After the extraction of said drill rod module (A) from the ground, said operating head (R) moves horizontally until the drill rod module (A) to be reinserted into the loader (101) is in position in front of and close to said extraction opening (43).

By moving the drill rod module (A) horizontally towards the inside of the loader (101), the latter presses on said rollers (51) and causes them to move. The operating head (R) moves further inserting the drill rod module (A) until it is aligned with the axis of said picking position (X).

At this point, said clamp (6) grips the drill rod module (A) to hold it during the release phase, which takes place by rotation of the spindle (R1) to unscrew the drill rod module (A).

After repositioning said drill rod module (A), said chains (2) slide, to place the next empty fork and cup (21, 22) in said picking position (X), into which the next drill rod module (A) extracted from the ground will be inserted.

In the event that the drilling takes place with drill covering modules, all drill rod modules (A) will first be extracted and individually positioned inside the loader (100) in consecutive seats.

The drill covering modules will then be positioned coaxially with respect to the drill rod modules (A) already housed in the loader.

Figure 3:
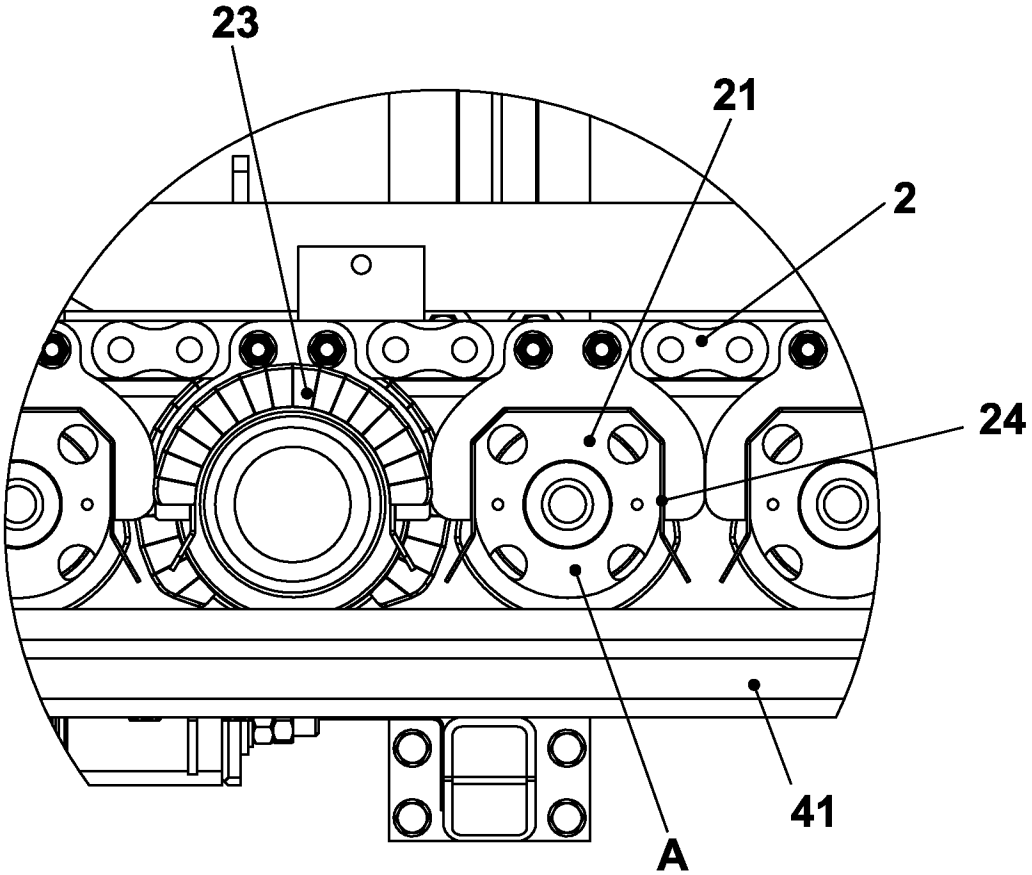
FIG. 3 shows another plan view of a detail of the new carousel, where the seats and forks (22, 23) to contain drill rod modules (A) and possibly also drill covering modules or other tools not shown in the figures can be identified.
Figure 4:
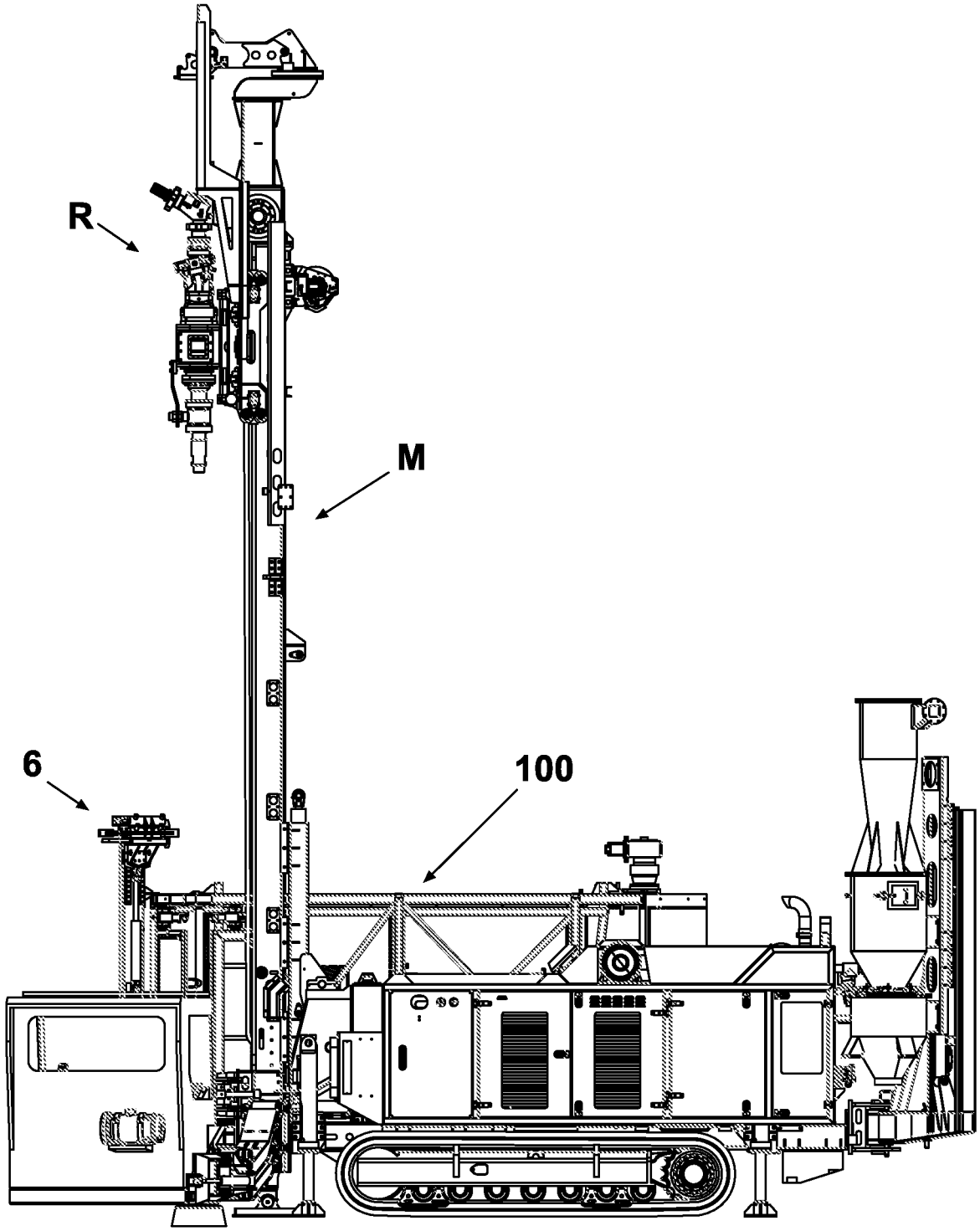
FIG. 4 shows a side view of the new drilling machine with carousel (100).
Figure 5:
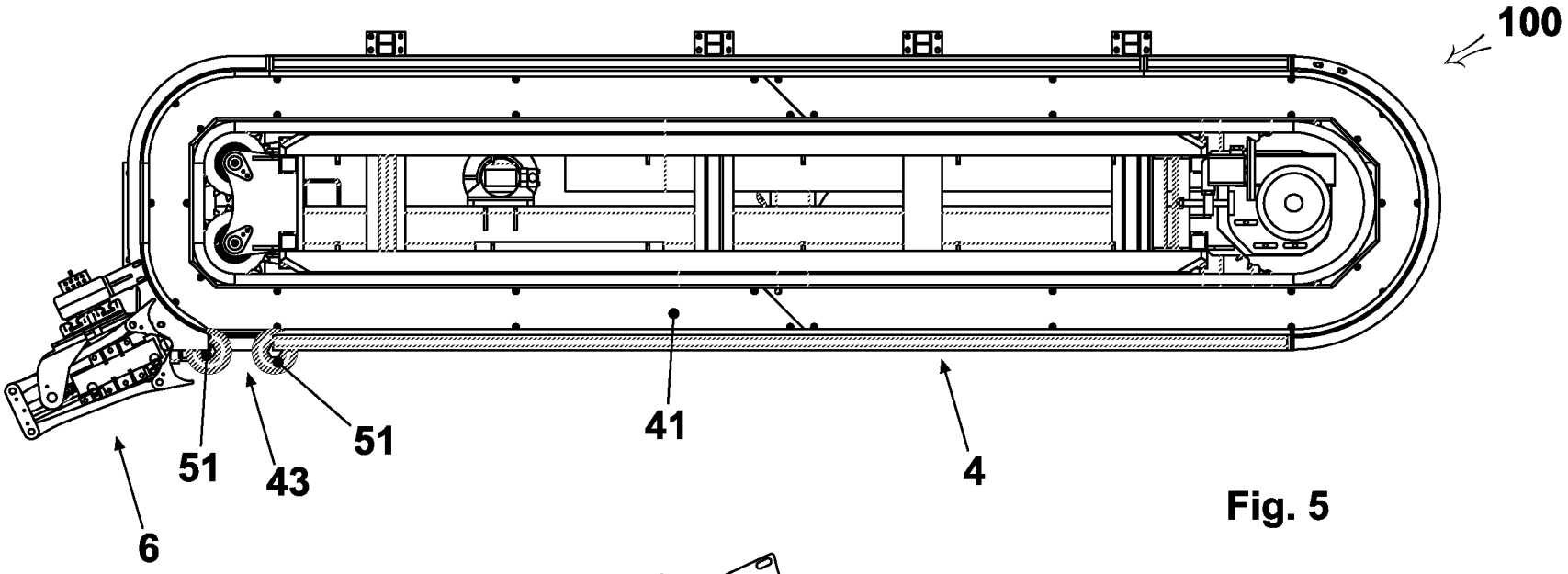
Figure 6:
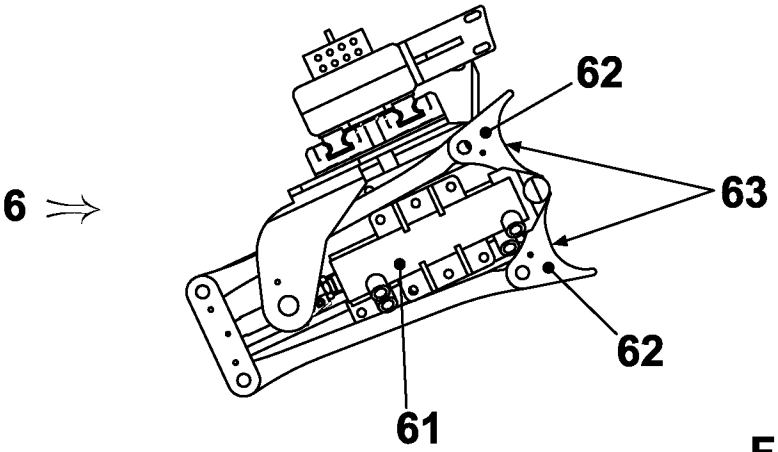
FIG. 6 shows only the locking clamp (6).

Said pulling means also comprise U-shaped guides (24), shown in detail in FIG. 3, placed orthogonally with respect to said platform (101) and integral with said chains (2) and therefore sliding together with them. Said guides (24) are suited to contain said drill rod (A) modules/drill covering modules, ensuring their stability during their transport and sliding process.

In particular, each of said guides (24) wraps around a drill rod module (A) or drill covering module on the side and behind, while from the front, that is, the part facing outwards with respect to the loader (101), said drill rod modules (A)/drill covering modules are retained by said containment frame (4).

In the preferred embodiment, said guides (24) contain said drill rod modules (A) and are in turn connected to the pulling system by said forks (21) and are integral with them.

Therefore, said drill rod modules (A) inside the loader (100), are not retained by gripping means but are free and contained between said guides (24) and said lateral containment frame (4).

Therefore, with reference to the preceding description and the attached drawings the following claims are made.

The invention claimed is:

1. A drilling machine comprising:

a machine body with a mast (M) provided with a rotary operating head (R) having a spindle for a rotational-translational motion of a rod module (A); and a loading device (100) of carousel type for a plurality of rod modules (A), the loading device comprising a platform (101) on which the rod modules (A) are arranged orthogonally to the platform (101), and a conveyor (2, 21, 22) for conveying the rod modules (A) along a closed path, wherein the loading device (100) comprises a lateral containment frame (4) for the rod modules (A), and wherein the containment frame (4) comprises an opening (43) configured to allow the rod modules (A) to be extracted and/or inserted by translating the rod modules in a direction parallel to the platform (101) or a direction having at least one component that is parallel to the platform (101), and wherein, at a level of the opening (43), there is a selective closing system (5) for closing the opening (43).

2. The drilling machine according to claim 1, wherein the rotary operating head (R) comprises a second spindle for a rotational-translational motion of a covering module designed to contain a rod module during drilling, and wherein the conveyor (2, 21, 22) belonging to the loading device (100) is configured to house the rod modules (A) and the covering modules coaxial with each other.

3. The drilling machine according to claim 2, wherein the conveyor comprises one or more chains (2) or belts sliding along the closed path and comprising a containment system (21, 22) for the rod modules (A)/covering modules, wherein the containment system (21, 22) is configured to directly or indirectly contain the rod modules (A)/covering modules orthogonally to the platform (101) and side by side or adjacently to each other along the closed path.

4. The drilling machine according to claim 3, wherein the containment system (21, 22) comprises forks (21) configured to connect the containment system to elements that convey the rod modules (A)/covering modules at an intermediate height, and/or cups (22) or seats configured to accommodate and hold a lower end (A2) of the rod modules (A)/covering modules.

5. The drilling machine according to claim 3, wherein the one or more chains (2) further comprise one or more forks and/or cups and/or seats (23) configured to hold one or more tools having any size and shape, positioned at a side of the rod modules (A)/covering modules and sliding therewith along the closed path.

6. The drilling machine according to claim 1, wherein a length of the rod modules (A) is of 2-3 meters.

7. The drilling machine according to claim 1, wherein the closing system (5) comprises at least one roller (51) constrained to the containment frame and movable between an obstructing position, in which the at least one roller at least partially obstructs the opening (43), and a position in which the at least one roller does not prevent a passage of a rod module (A) or of a covering module or of a tool through the opening (43).

8. The drilling machine according to claim 7, wherein the at least one roller (51) is elastically constrained to the containment frame (4).

9. The drilling machine according to claim 7, wherein closing system (5) comprises a plurality of rollers, of which two are arranged symmetrically at two sides of the opening (43).

10. The drilling machine according to claim 7, wherein a movement of the closing system (5) takes place automatically or through a simple direct pushing action of the rod modules (A) or of covering modules or of tools grasped by the operating head (R).

11. The drilling machine according to claim 4, further comprising a locking device or a clamp (6) for locking a rod module (A)/a covering module during a step in which the operating head (R) grasps or releases the rod module (A)/the covering module arranged in a given grasping position (X) inside the loading device.

12. The drilling machine according to claim 11, wherein the clamp (6) performs a translational motion between a starting backward position and a forward position in which the clamp grasps the rod module (A) or the covering module or a tool in a grasping position (X), and vice versa.

13. The drilling machine according to claim 11, wherein the containment system further comprises U-shaped guides (24) arranged orthogonally with respect to the platform (101) and integral with the chains (2) and sliding together therewith, and wherein the guides (24) are configured to contain the rod modules (A) and the covering modules at a sides and at a back on a side facing towards an inside of the loading device (101), and are held by the forks (21) and are integral therewith.

14. The drilling machine according to claim 11, wherein the rod modules (A) are positioned inside the loading device (100) in positions in which the rod modules are coaxial with the covering modules.

* * * * *